US009402418B2

(12) United States Patent
Barkley

(10) Patent No.: US 9,402,418 B2
(45) Date of Patent: Aug. 2, 2016

(54) APPARATUS AND METHOD FOR ROLLING CIGARETTE FILTERS

(71) Applicant: Richard Douglas Barkley, Williamsburg (CA)

(72) Inventor: Richard Douglas Barkley, Williamsburg (CA)

(73) Assignee: Richard Douglas Barkley, Ontario (CA)

( * ) Notice: Subject to any disclaimer, the term of this patent is extended or adjusted under 35 U.S.C. 154(b) by 561 days.

(21) Appl. No.: 13/962,988

(22) Filed: Aug. 9, 2013

(65) Prior Publication Data

US 2014/0274631 A1 Sep. 18, 2014

(30) Foreign Application Priority Data

Mar. 18, 2013 (CA) ..... 2809814

(51) Int. Cl.
*A24D 3/02* (2006.01)

(52) U.S. Cl.
CPC ..... *A24D 3/0245* (2013.01)

(58) Field of Classification Search
CPC ..... A24D 3/0245; A24D 3/00; A24D 1/022; A24D 3/04
USPC ..... 493/50, 4, 34, 39, 42
See application file for complete search history.

(56) References Cited

U.S. PATENT DOCUMENTS

| | | | | |
|---|---|---|---|---|
| 3,759,421 | A * | 9/1973 | Hausmann | B65D 35/32 222/99 |
| 5,195,691 | A | 3/1993 | Pfeiffer | |
| 2011/0088709 | A1 | 4/2011 | Koshiishi | |
| 2011/0192409 | A1 | 8/2011 | Jurado | |

FOREIGN PATENT DOCUMENTS

| | | |
|---|---|---|
| DE | 19743182 | 8/1999 |
| GB | 438206 | 8/1935 |
| WO | 7900887 | 3/1979 |
| WO | 2004086887 | 10/2004 |
| WO | 2012064735 | 5/2012 |

* cited by examiner

*Primary Examiner* — Robert Long
*Assistant Examiner* — Xavier A Madison
(74) *Attorney, Agent, or Firm* — Adam K. Sacharoff; Much Shelist

(57) ABSTRACT

An apparatus and method for making a coiled cigarette filter is described. The apparatus includes a winding pin having a pinhead and a pin body, the pin body having a slot therein, separating the pin body into a first leg and a second leg. The winding pin is secured to a pin holder for synchronized rotation therewith, such that the pin body extends beyond one end of the pin holder to expose a length of the pin body. One end of a sheet of cigarette filter paper is inserted into the slot in the pin body and the pin holder is rotated in one direction causing the cigarette filter paper to wind around the pin body forming the coiled cigarette filter. Included as well is a pin cover, which is removeably attached to the pin holder for protecting the pin body when not in use.

24 Claims, 5 Drawing Sheets

APPARATUS AND METHOD FOR ROLLING CIGARETTE FILTERS

FIELD OF THE INVENTION

This invention relates to an apparatus and a method for rolling cigarette filters and cigarette filter tips, sometimes referred to as "roach filters" or "roaches". In particular the invention is a method and apparatus for rolling cigarette filter paper and other types of paper to make coiled roach filters. The roach filter is used at one end of a hand-rolled cigarette to keep the smoking materials from touching the smoker's lips, while at the same time permitting the smoke to pass through and allowing the entire contents of the cigarette to be fully smoked without leaving a butt.

BACKGROUND OF THE INVENTION

When producing a hand-rolled cigarette, the smoking materials, such as tobacco, herbal preparations, or medicinal marijuana, are wrapped in specially prepared cigarette papers to form a tightly packed tube of smoking material, which is sealed into a cylinder about the same diameter as a standard manufactured cigarette with the application of some adhesive to the edge of the cigarette paper. The end of the cigarette to be lighted may be left open or sealed off by twisting the paper into a tight spiral, while the other smoking end is left open. As shown in FIG. 1, to prevent smoking materials from falling out of the smoking end 2 of cigarette 1, a small sheet of filter paper 10 is rolled into a tight coil to make a cigarette filter or roach 12, which is placed into the open smoking end 2 of the cigarette 1. The coiled roach filter 12 is rolled to a diameter that is slightly less than the diameter of the open smoking end of the cigarette so that it may be easily inserted therein. Once inserted, the coiled roach filter 12 is allowed to expand slightly to the inside diameter of the cigarette, so that it is thereby held in place by the expansive force exerted by the coiled roach filter 12 against the inside of the cylinder of cigarette paper. It is often helpful to tamp down the smoking materials at the open end of the cigarette to compact the smoking materials and create some room to insert the roach filter. A small stick or head of a nail is often used for this tamping process.

Advantages of using a roach filter at the smoking end of a hand-rolled cigarette are that the roach filter provides a convenient place for the smoker to grip the cigarette between his or her lips and it keeps the hot smoking materials from touching the lips. Further, the open coiled shape of the roach filter permits smoke to pass through without removing taste or active ingredients, and permits the entire cigarette to be fully consumed.

As shown in FIG. 1, rolling the roach filter 12 is a tricky process that involves wrapping a small piece of stiff filter paper or light cardboard 10 into a tight coil. This is usually done by hand and often takes several attempts to succeed in getting the filter paper coiled to the correct diameter at sufficient tension to function properly as a roach filter. The filter paper must first be folded at one end to assist in starting the coil. Then the folded end is rolled between the fingers until a tight coil is formed. This often takes several attempts and if the right tension is not obtained, the coil must be unwrapped and the process started again. The rolling process, when performed by hand, takes time, requires a keen eye, a steady hand and a high degree of manual dexterity since the filter paper is not very large compared to the size of a human hand. Consistent results are difficult to obtain.

The applicant is unaware of any solutions that have been put forward to solve the problem of producing roach filters quickly and consistently for use in hand-rolled cigarettes.

U.S. Patent Publication No. 2011/0088709 to Koshiishi, published on Apr. 21, 2011, describes a tobacco filter that can be used to easily produce a hand-rolled cigarette by wrapping a portion of the filter with the wrapping paper and smoking material, but there is no teaching of a device or method for easily preparing a coiled roach filter for use with the hand-rolled cigarette.

International patent publication No. WO 2012/064735 to Sinclair et al., published on May 18, 2012, describes filter strips that can be used to construct filter tips for custom cigars and cigarettes. The filter strip may be folded into a spiral filter tip that can be used to assist in rolling by hand a substantially cylindrical or conical cigarette and to prevent tobacco from being drawn into a smoker's mouth during smoking. Sinclair et al. describes forming a filter tip by placing one end of the filter strip between a user's thumb and forefinger and first folding it into a zigzag shape. Then the remaining length of the filter paper is rolled around the zigzag shape to produce a coiled filter tip. There is no mention of using a mechanical device to assist in rolling the coiled filter tip.

International patent publication No. WO 2004/086887 to Aish et al., published on Oct. 14, 2004, describes a cylindrical element (10) with a slit or groove (20) extending a portion of its length into which a cigarette paper may be inserted. Rolling the cigarette paper containing the smoking materials around the cylinder assists in forming a cigarette. There is no description of a device or method for making a roach filter.

U.S. Pat. No. 3,759,421 to Hausmann, European Patent No. EP0011633 to Rosenlind et al., German Patent Application No. DE19743182A1 to Scherbel, and U.K. Patent No. GB428,206 to Elboz, all disclose turn keys for assisting in the extrusion of ingredients from collapsible tubes, such as toothpaste or anchovy tubes. Elboz, Rosenlind, and Scherbel disclose keys having two parallel prongs with a space disposed between the prongs. The prongs are open at one end to permit introduction of the tube material, and closed at the other end where various types of handles are formed. Turning the keys using the handle tends to form a spiral in the tube material. Hausmann accomplishes the same task as the other keys, but comprises a hollow cylinder or shaft (1) with a longitudinal slit (3) along its length and a handle (2) at one end. None of these references disclose securing the prongs into a housing so that the prongs are protected when the apparatus is not in use. Nor is there any description of a device or method for making a coiled roach filter for a cigarette.

What is needed then is a device and method to assist the smoker in quickly constructing a coiled roach filter for use in making hand-rolled cigarettes.

SUMMARY OF THE INVENTION

The present method and apparatus for rolling cigarette filters addresses the above-noted need and solves the problems described in the prior art.

In accordance with one aspect then, there is provided an apparatus for making a coiled cigarette filter by rolling up a sheet of cigarette filter paper, the apparatus comprising: a winding pin, the winding pin comprising a pin body, the pin body having a slot therein, the slot separating the pin body into a first leg and a second leg; a pin holder having a first end and a second end; and means for securing the winding pin to the pin holder for synchronized rotation therewith such that an exposed end of the pin body extends beyond the first end of the pin holder by a pre-determined length, whereby insertion of one end of the sheet of cigarette filter paper into the slot in the pin body, followed by rotation of the pin holder in one direction causes the cigarette filter paper to wind around the pin body forming the coiled cigarette filter.

In other aspects, the apparatus includes a pin cover that is removeably attached to the first end of the pin holder to protect the winding pin when not in use. The pin cover may be threadably attached to the pin holder or attached in some other manner known in the art, such as by a snap fit or friction fit. The pin cover may include a pin cover hole therein to fully accommodate and enclose the winding pin when the pin cover is attached to the pin holder, and the pin cover may include a keyhole therein for attachment of a key ring or the like.

In another aspect, the means for securing the winding pin to the pin holder comprises: a pinhole in the first end of the pin holder, the pinhole having a first diameter, an inner end, and an opposite outer end; a screw hole in the second end of the pin holder, the screw hole having a second diameter, an inner end, and an opposite outer end; wherein the first diameter is less that the second diameter, and wherein the inner end of the pinhole and the inner end of the screw hole meet on a common interior plane of the pin holder, and wherein the winding pin has a pin head that is larger in diameter than the diameter of the pin body, and wherein the first diameter of the pinhole is larger than the diameter of the pin body and smaller than the diameter of the pin head, and wherein the second diameter of the screw hole is larger than the diameter of the pin head, thereby permitting the winding pin to be inserted into the pin holder through the outer end of the screw hole and into the inner end of the pinhole such that the pin body extends beyond the first end of the pin holder and the pin head remains within the pin holder at the common interior plane, and a fixing screw threaded into the screw hole against the pin head to secure the pinhead at the interior end of the pinhole.

In further aspects, the slot between the first and second legs of the pin body has a width that is tapered inward so that the slot becomes more narrow as the slot extends nearer to the first end of the pin holder. The winding pin may be constructed from a single piece of wire. The first leg of the pin body may be longer than the second leg of the pin body, thereby creating an offset between the first leg and the second leg at the exposed end of the pin body. The cross-section of one or both of the first and second legs is a semi-circle and each semi-circle has an inner flat surface and an outer curved surface, wherein the inner flat surfaces oppose each other across the slot.

In accordance with another aspect, there is provided a method of making a coiled cigarette filter, the method comprising the steps of: inserting one end of a sheet of filter paper into a slot separating a first leg and a second leg of a pin body of a winding pin, the winding pin secured to a pin holder for synchronized rotation therewith such that the pin body extends beyond a first end of the pin holder to expose a pre-determined length of the pin body; rotating the pin holder in one direction to thereby cause the sheet of filter paper to be wound around the pin body of the winding pin, thereby creating the coiled cigarette filter; and removing the coiled cigarette filter from the winding pin.

In further aspects, the method includes the further step of maintaining a tension between the winding pin and the sheet of filter paper as the filter paper is being wound around the pin body of the winding pin. The method may include the further step of inserting the coiled cigarette filter into an open end of a hand-rolled cigarette before removing the coiled cigarette filter from the winding pin. Following removal of the coiled cigarette filter a pin cover may be attached to the first end of the pin holder to protect the winding pin when not in use.

BRIEF DESCRIPTION OF THE DRAWINGS

Referring to the drawings wherein like reference numerals indicate similar parts throughout the several views, several aspects of the method and apparatus for rolling cigarette filters are illustrated by way of example, and not by way of limitation, in detail in the figures, wherein.

DETAILED DESCRIPTION OF THE INVENTION

Various embodiments of the applicant's method and apparatus for rolling cigarette filters will now be discussed in detail.

Figure 2:
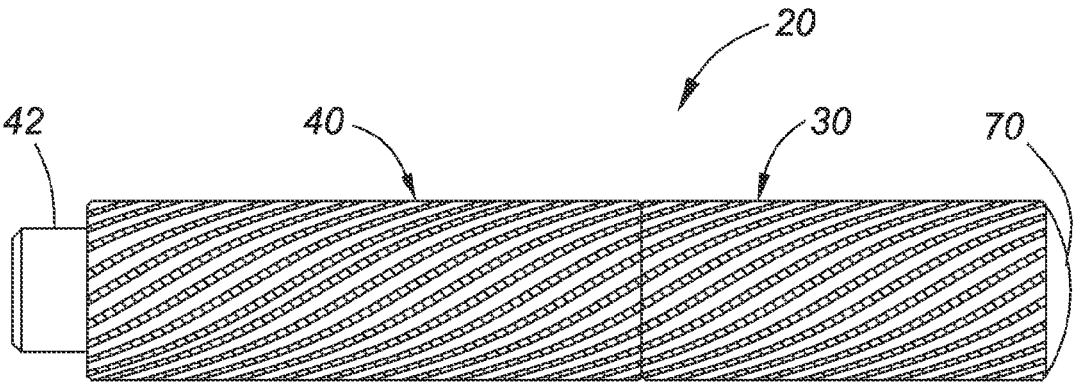
FIG. 2 is a side view of one embodiment of a fully assembled cigarette filter rolling apparatus.

FIG. 2 shows a fully assembled apparatus 20 for making a coiled cigarette filter or roach 12. The apparatus 20 includes a pin holder 30 at one end, and a pin cover 40 at an opposite end. Pin cover 40 is removeably attached to pin holder 30 by a threaded attachment, or by some other means known to those skilled in the art, such as by a friction fit, or a snap fit. Pin cover 40 may include a small extension 42 into which a keyhole 44 may be drilled (see FIG. 5) for attachment of a key ring (not shown). The exterior surface of the pin holder 30 and the pin cover 40 may be textured to provide grip.

The apparatus 20 may be made of any suitable material, such as metal, plastic, carbon fiber, glass, ceramic or wood or a combination of any of these materials. The apparatus 20 as shown in the drawings is cylindrical in shape, however, those skilled in the area will appreciate that the cylindrical outer shape of the apparatus is not essential, and that any desired shape would function as well, including a square or rectangular shape, an oval shape or an ergonomic shape designed to accommodate a user's fingers.

Figure 5:
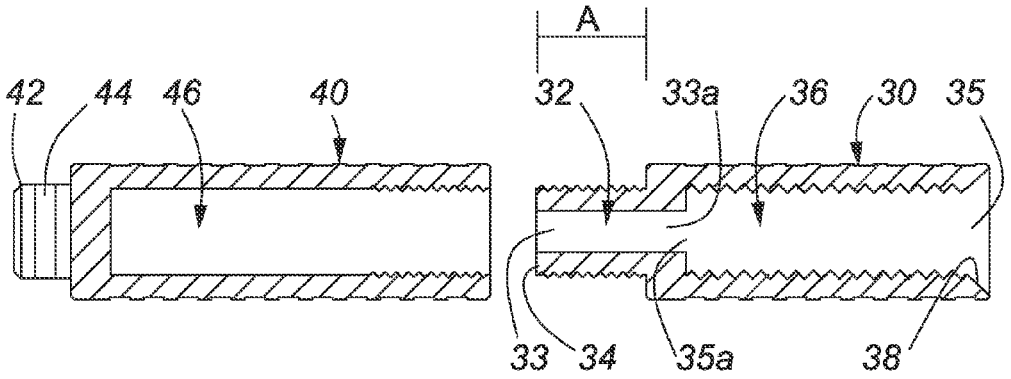
FIG. 5 is a cross sectional view of a pin holder and a pin cover of the present apparatus for rolling cigarette filters.

As shown in cross-section in FIG. 5, pin holder 30 is made from a solid piece of material having a pinhole 32 cut into the center of a first end 34 of the pin holder 30 and a screw hole 36 cut into the center of an opposite second end 38 of the pin holder 30. The pinhole 32 has an outer end 33 and an inner end 33*a* and the screw hole 36 has an outer end 35 and an inner end 35*a*. The inner end 33*a* of the pinhole 32 and the inner end 35*a* of the screw hole 36 meet on a common plane on the interior of pin holder 30.

Figure 3:
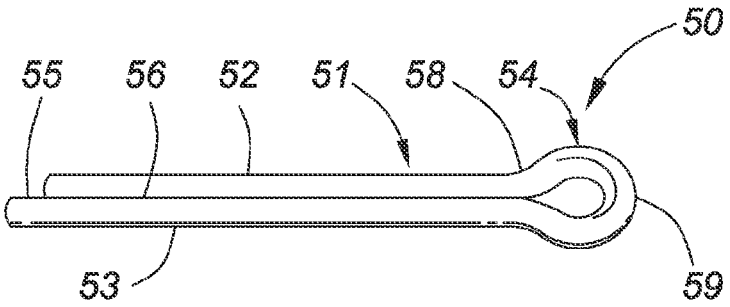
FIG. 3 is a perspective view of a winding pin used in construction of the present cigarette filter rolling apparatus.
Figure 4:
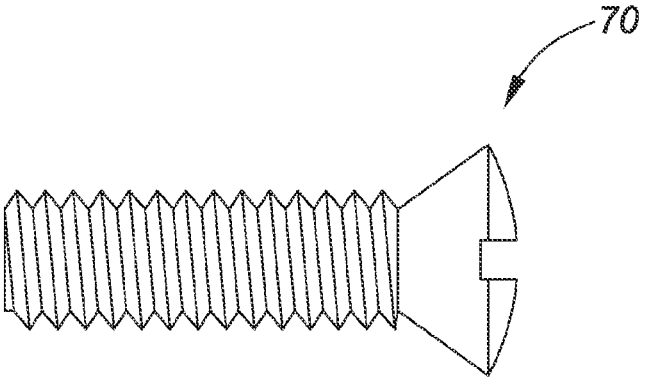
FIG. 4 is a side view of a fixing screw used in construction of the present cigarette filter rolling apparatus.
Figure 6:
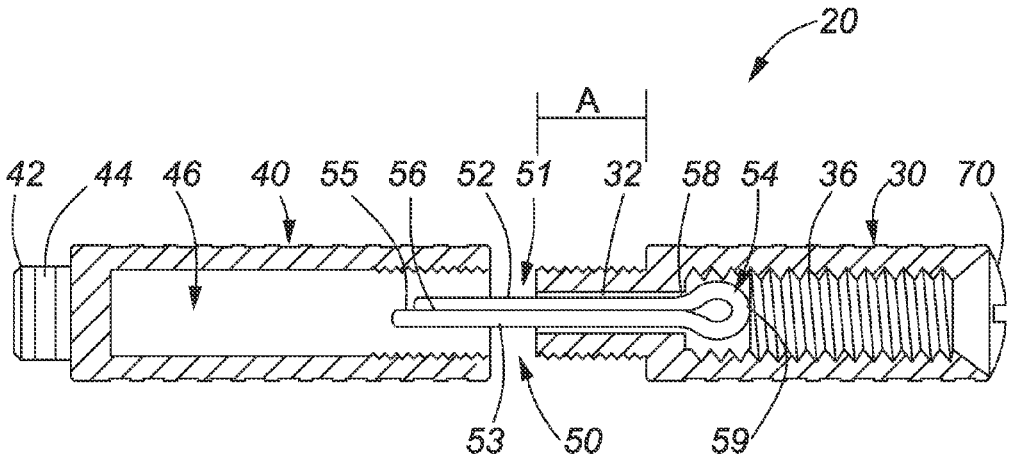
FIG. 6 is a cross sectional view of a pin holder and pin cover of the present apparatus for rolling cigarette filters, showing a winding pin installed and held in place in the pin holder with the fixing screw.
Figure 11:
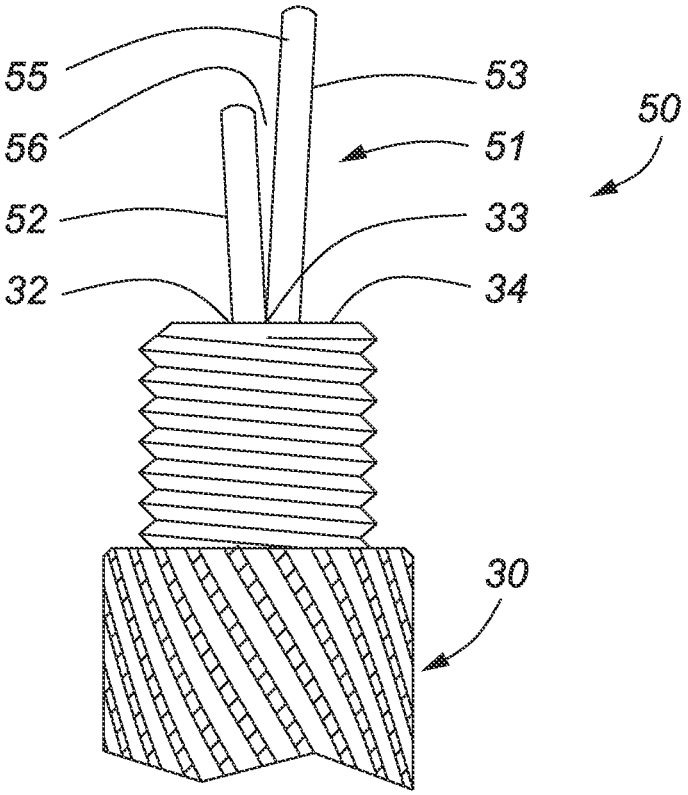
FIG. 11 is a side view of one end of a pin holder of the present apparatus for rolling cigarette filters, showing a winding pin extending therefrom.

The pinhole 32 is designed to accommodate insertion of a winding pin 50 as shown in FIGS. 3 and 6. Winding pin 50 has a pin body 51 and a pinhead 54. The pinhead 54 includes a top 59 and a base 58 connected to the pin body 51. The pin body 51 is smaller in diameter than the pinhead 54 and includes a slot 56 separating the pin body into first and second legs 52, 53. The slot 56 between legs 52, 53 may extend the full length of the pin body 51 or only a portion of the length of the pin body provided that the length of the slot 56 is sufficient to accommodate the maximum desired length of roach filter 12 that a user wishes to make. As shown best in FIG. 11, the slot 56 may be tapered so that the width of the slot near the outer end of the pin body 51 is greater than the width of the slot nearer to the pinhead 54. The tapering of the slot 56 is useful for facilitating the insertion of the sheet of filter paper 10 into the wider open end, while the narrower portion, which preferably tapers to a width less than the thickness of the filter paper, functions to grab and hold the filter paper during the winding process.

As shown in FIGS. 3 and 6, the winding pin 50 may be constructed from a single piece of wire bent into a flattened "U" shape that is expanded and crimped at one end to form the larger diameter pinhead 54. Other means for construction of a suitable winding pin 50 are contemplated by the applicant and will be well known to those skilled in the art. The applicant has found that a standard cotter pin may be used for winding pin 50.

Figure 10:
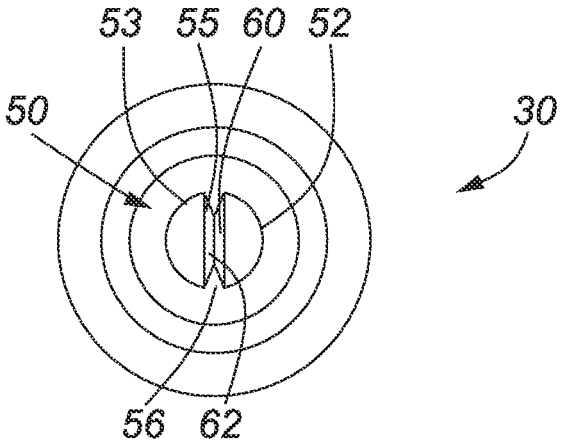
FIG. 10 is an end view of a winding pin and pin holder of the present apparatus for rolling cigarette filters.

Advantageously, one of the legs 52, 53 of the winding pin is made longer than the other, thereby creating an offset 55, the offset making it easier to locate the slot 56 for insertion of the sheet of filter paper 10 between the legs 52, 53. A further advantage may be created by constructing the winding pin 50 and the slot 56 so that each leg 52, 53 has a semi-circular cross section with two opposing flat surfaces 60, 62 as shown in FIG. 10. The two opposing flat surfaces 60, 62 of the legs 52, 53 assist in maintaining a tight grip on the filter paper 10 inserted between the two legs during the winding process.

The diameter of the screw hole 36 in the pin holder 30 is larger than the outside diameter of the pinhead 54 and is internally threaded to accept a fixing screw 70 therein. The diameter of the pinhole 32 is smaller than the diameter of the pinhead 54 and only slightly larger than the diameter of pin body 51 to thereby allow the winding pin 50 to be inserted through the screw hole 36 and into the pinhole 32 up to the base 58, as shown in FIG. 6. The fixing screw 70 is threaded into the screw hole 36 up against the top 59 of the pinhead 54 to thereby securely hold the winding pin 50 in place within the pin holder 30. The slotted pin body 51 is of sufficient length such that a portion of the pin body 51 protrudes out of the pinhole 32, extending a predetermined length beyond the first end 34 of the pin holder 30. The distance that the pin body 51 extends beyond the first end 34 of the pin holder 30 is determined by the maximum desired length of roach filter 12 that a user wishes to make.

The outer diameter of a length A of the first end 34 of the pin holder 30 is reduced compared to the outer diameter of the second end 38 and is externally threaded as shown in FIGS. 5 and 6, to accept the internally threaded pin cover 40 that may be threaded over the first end 34 to protect the slotted pin body 51 when the apparatus 20 is not in use. As discussed above, pin cover 40 may be attached to pin holder 30 by some other means known to those skilled in the art, such as by a friction fit, or a snap fit.

The pin cover 40 is made from a solid piece of material and has a central pin cover hole 46 extending through most of its length. The lengths and diameters of the pin cover 40 and the pin cover hole 46 are selected so that when the pin holder 30 is fully threaded into the pin cover 46, as shown in FIG. 2, the pin body 51 is fully accommodated within the pin cover hole 46. Pin cover 40 may include extension 42 into which keyhole 44 may be drilled for attaching keys or the like.

Figure 1:
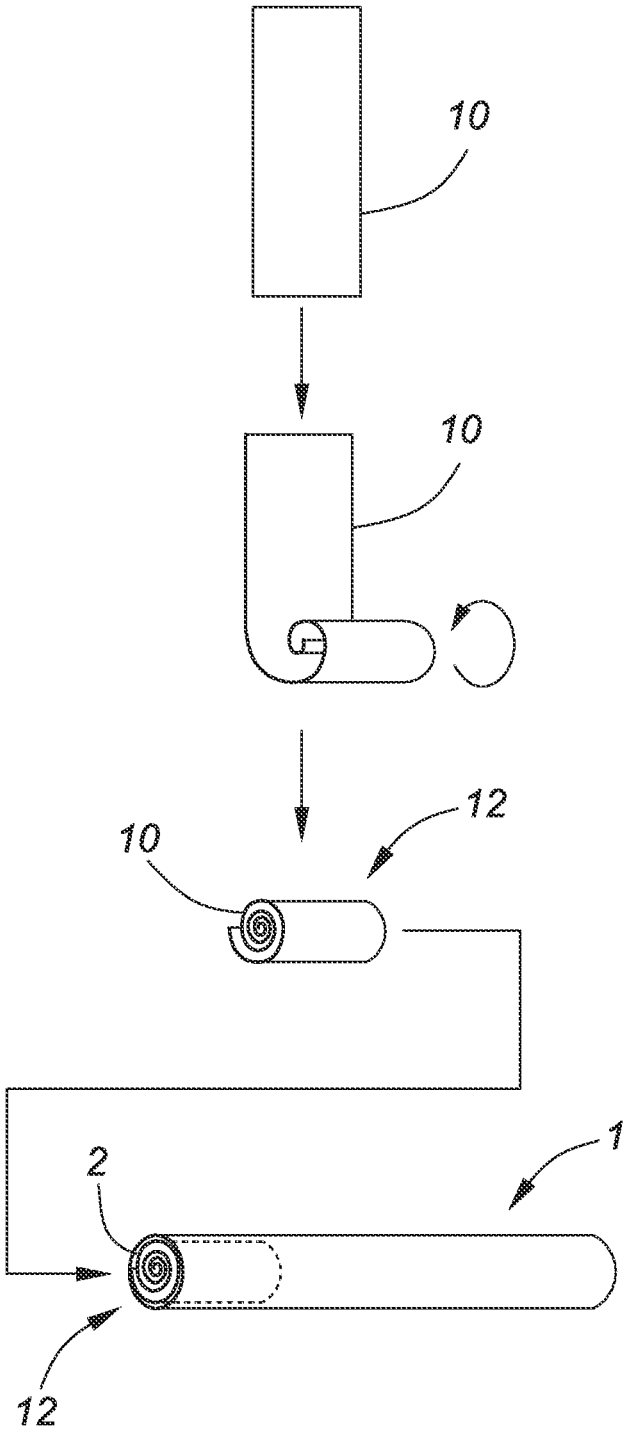
(PRIOR ART) FIG. 1
FIG. 1 is a perspective view of the prior art, showing the steps of manually producing a coiled roach filter for a cigarette.
Figure 7:
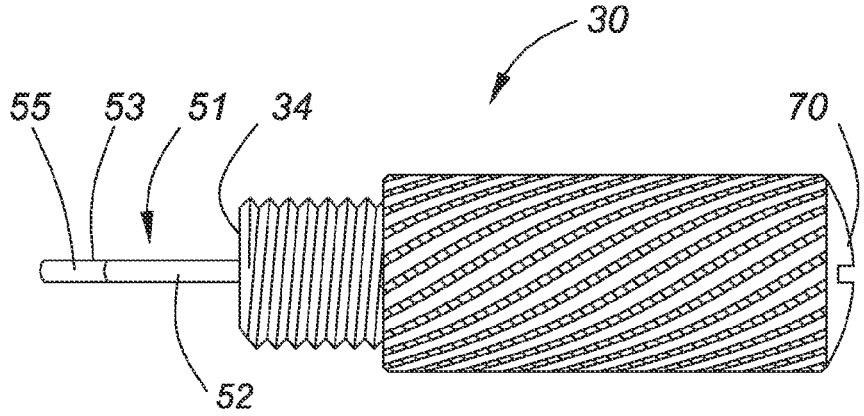
FIG. 7 is top view of a pin holder and winding pin of the present apparatus for rolling cigarette filters.
Figure 8:
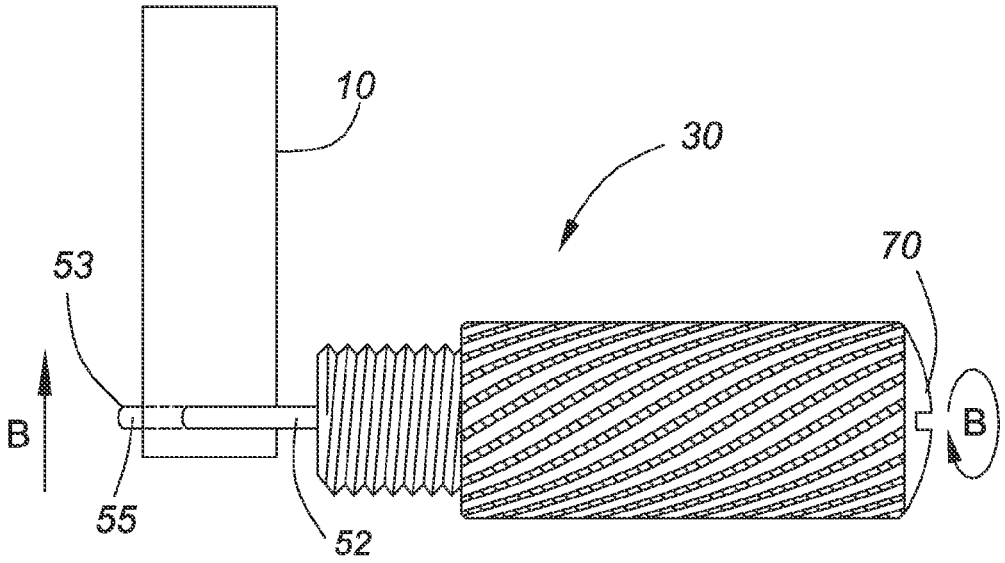
FIG. 8 is a top view of a pin holder of the present apparatus for rolling cigarette filters, showing a filter paper inserted into the slot in the winding pin.
Figure 9:
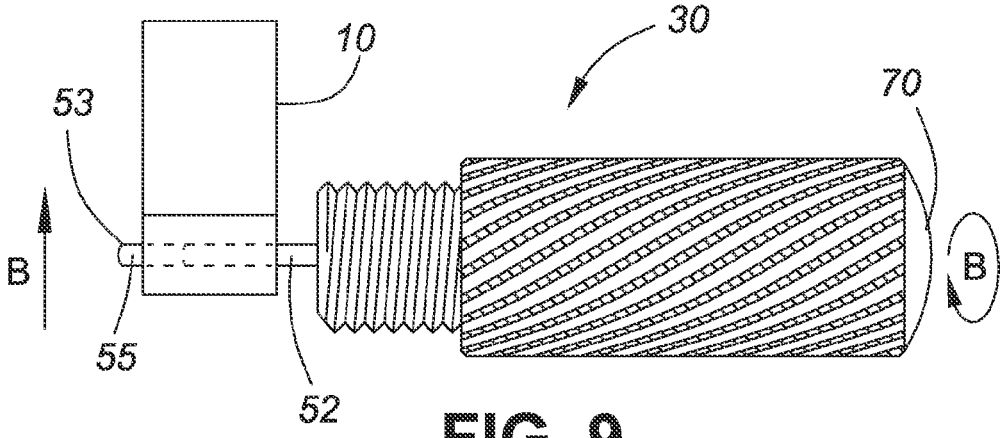
FIG. 9 is a top view of a pin holder of the present apparatus for rolling cigarette filters, showing a partially rolled filter paper on the winding pin.

Reference is now made to FIGS. 7, 8 and 9 to describe the operation of the apparatus 20 and a method for making the coiled roach filter 12. In operation, the pin cover 40 is removed from the pin holder 30, and the pin holder 30 is positioned with the offset 55 facing upward, as shown in FIG. 7. As shown in FIG. 8, the edge of one end of a thin strip of filter paper 10 is placed on the offset 55 and gently inserted into the slot 56 between legs 52, 53 of winding pin body 51. Then the entire pin holder 30 is rotated in direction B (as shown in FIGS. 8 and 9), thereby rolling the filter paper 10 into a tightly coiled roach filter 12 around the winding pin 50. The applicant has found that by maintaining some tension between the filter paper 10 and the winding pin 50, as the filter paper is being wound around the winding pin, a suitably tight coil shape can be maintained. Once the entire filter paper 10 has been wound-up around the winding pin 50, the coiled roach filter 12 is removed from the winding pin 50 and inserted into the open end 2 of cigarette 1 (see FIG. 1). The user should be careful to maintain the coiled tension in the roach filter 12 by holding it tightly between the fingers prior to insertion in the cigarette. As the coiled roach filter 12 is inserted into the open end of the cigarette and the tension on the coil is released, the coil expands slightly to conform to the inside diameter of the cigarette 1. The tension between the roach filter coil 12 and the inside of the cigarette paper tube holds the roach filter 12 in place at the open end of the cigarette 1. The roach filter 12 provides a finished end for the cigarette through which smoke may be drawn while maintaining a sufficient distance between the smoking materials and the user's lips.

In the alternative, once the filter paper 10 has been wound into a tightly coiled roach filter 12 on the end of the winding pin 50, the roach filter 12 may be held in place with the user's finger while it is inserted into the open end 2 of the cigarette 1. Once inserted, the coiled tension on the roach filter 12 is released, the coil expands to fill the entire diameter of the cigarette, and the winding pin 50 is extracted.

One further convenient use for the pin holder 30 with the winding pin 50 extending therefrom, is to use the protruding end of the winding pin 50 to tamp down the smoking materials in the open end 2 of the cigarette 1, to make room for insertion of the roach filter 12.

The previous detailed description is provided to enable any person skilled in the art to make or use the present apparatus and method for rolling cigarette filters. Various modifications to these embodiments will be readily apparent to those skilled in the art, and the generic principles defined herein may be applied to other embodiments without departing from the scope of the apparatus and method for rolling cigarette filters as defined by the appended claims. Thus, the present apparatus and method for rolling cigarette filters is not intended to be limited to the embodiments shown herein, but is to be accorded the full scope consistent with the appended claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. An apparatus for making a coiled cigarette filter by rolling up a sheet of cigarette filter paper, the apparatus comprising:

a winding pin, the winding pin comprising a pin body, the pin body having a slot therein, the slot separating the pin body into a first leg and a second leg;

a pin holder having a first end and a second end; and means for securing the winding pin to the pin holder for synchronized rotation therewith such that an exposed end of the pin body extends beyond the first end of the pin holder by a pre-determined length, whereby insertion of one end of the sheet of cigarette filter paper into the slot in the pin body, followed by rotation of the pin holder in one direction causes the cigarette filter paper to wind around the pin body forming the coiled cigarette filter.

2. The apparatus of claim 1, further comprising a pin cover removeably attached to the first end of the pin holder to protect the winding pin when not in use.

3. The apparatus of claim 2, wherein the pin cover is threadably attached to the pin holder.

4. The apparatus of claim 2, wherein the pin cover includes a pin cover hole therein to fully accommodate and enclose the winding pin when the pin cover is attached to the pin holder.

5. The apparatus of claim 2, wherein the pin holder includes a keyhole therein for attachment of a key ring.

6. The apparatus claim 1, wherein the means for securing the winding pin to the pin holder comprises:

a pinhole in the first end of the pin holder, the pinhole having a first diameter, an inner end, and an opposite outer end;

a screw hole in the second end of the pin holder, the screw hole having a second diameter, an inner end, and an opposite outer end;

wherein the first diameter is less that the second diameter, wherein the inner end of the pinhole and the inner end of the screw hole meet on a common interior plane of the pin holder, wherein the winding pin has a pin head that is larger in diameter than the diameter of the pin body, wherein the first diameter of the pinhole is larger than the diameter of the pin body and smaller than the diameter of the pin head, wherein the second diameter of the screw hole is larger than the diameter of the pin head, thereby permitting the winding pin to be inserted into the pin holder through the outer end of the screw hole and into the inner end of the pinhole such that the pin body extends beyond the first end of the pin holder and the pin head remains within the pin holder at the common interior plane, and a fixing screw threaded into the screw hole against the pin head to secure the pinhead at the interior end of the pinhole.

7. The apparatus of claim 1, wherein the slot between the first and second legs of the pin body has a width that is tapered inward so that the slot becomes more narrow as the slot extends nearer to the first end of the pin holder.

8. The apparatus of claim 1, wherein the winding pin is constructed from a single piece of wire.

9. The apparatus of claim 1, wherein the first leg of the pin body is longer than the second leg of the pin body, thereby creating an offset between the first leg and the second leg at the exposed end of the pin body.

10. The apparatus of claim 1, wherein a cross-section of at least one of the first and second legs is a semi-circle.

11. The apparatus of claim 1, wherein a cross-section of each of the first and second legs is a semi-circle, each semi-circle having an inner flat surface and an outer curved surface, wherein the inner flat surfaces oppose each other across the slot.

12. A method of making a coiled cigarette filter, the method comprising the steps of:

inserting one end of a sheet of filter paper into a slot separating a first leg and a second leg of a pin body of a winding pin, the winding pin secured to a pin holder for synchronized rotation therewith such that the pin body extends beyond a first end of the pin holder to expose a pre-determined length of the pin body;

rotating the pin holder in one direction to thereby cause the sheet of filter paper to be wound around the pin body of the winding pin, thereby creating the coiled cigarette filter; and removing the coiled cigarette filter from the winding pin.

13. The method of claim 12, including the further step of maintaining a tension between the winding pin and the sheet of filter paper as the filter paper is being wound around the pin body of the winding pin.

14. The method of claim 12, including the further step of inserting the coiled cigarette filter into an open end of a hand-rolled cigarette before removing the coiled cigarette filter from the winding pin.

15. The method of claim 12, including the further step of attaching a pin cover to the first end of the pin holder to protect the winding pin following removal of the coiled cigarette filter.

16. The method of claim 15, wherein the pin cover is threadably attached to the pin holder.

17. The method of claim 15, wherein the pin cover includes a pin cover hole therein to fully accommodate and enclose the winding pin when the pin cover is attached to the pin holder.

18. The method of claim 15, wherein the pin holder includes a keyhole therein for attachment of a key ring.

19. The method of claim 12, wherein the pin holder comprises:

a pinhole in the first end of the pin holder, the pinhole having a first diameter, an inner end, and an opposite outer end;

a screw hole in the second end of the pin holder, the screw hole having a second diameter, an inner end, and an opposite outer end;

wherein the first diameter is less that the second diameter, wherein the inner end of the pinhole and the inner end of the screw hole meet on a common interior plane of the pin holder, wherein the winding pin has a pin head that is larger in diameter than the diameter of the pin body, wherein the first diameter of the pinhole is larger than the diameter of the pin body and smaller than the diameter of the pin head, wherein the second diameter of the screw hole is larger than the diameter of the pin head, thereby permitting the winding pin to be inserted into the pin holder through the outer end of the screw hole and into the inner end of the pinhole such that the pin body extends beyond the first end of the pin holder and the pin head remains within the pin holder at the common interior plane, and the winding pin is secured to the pin holder by a fixing screw threaded into the screw hole against the pin head to secure the pinhead at the interior end of the pinhole.

20. The method of claim 12, wherein the slot between the first and second legs of the pin body has a width that is tapered inward so that the slot becomes more narrow as the slot extends nearer to the first end of the pin holder.

21. The method of claim 12, wherein the winding pin is constructed from a single piece of wire.

22. The method of claim 12, wherein the first leg of the pin body is longer than the second leg of the pin body, thereby creating an offset between the first leg and the second leg at an exposed end of the pin body.

23. The method of claim 12, wherein a cross-section of at least one of the first and second legs is a semi-circle.

24. The apparatus of claim 12, wherein a cross-section of each of the first and second legs is a semi-circle, each semi-circle having an inner flat surface and an outer curved surface, wherein the inner flat surfaces oppose each other across the slot.

* * * * *